US006817832B2

(12) United States Patent
Kim et al.

(10) Patent No.: US 6,817,832 B2
(45) Date of Patent: Nov. 16, 2004

(54) CENTRIFUGAL BLOWER WITH EDDY BLADE

(75) Inventors: Jae-Won Kim, Seoul (KR); Kwan-Tae Kim, Seoul (KR)

(73) Assignee: Sun Moon University, Asan (KR)

( * ) Notice: Subject to any disclaimer, the term of this patent is extended or adjusted under 35 U.S.C. 154(b) by 0 days.

(21) Appl. No.: 10/309,305

(22) Filed: Dec. 2, 2002

(65) Prior Publication Data

US 2004/0071549 A1 Apr. 15, 2004

(30) Foreign Application Priority Data

Oct. 9, 2002 (KR) ..... P2002-0061438

(51) Int. Cl.[7] ..... F01D 1/02

(52) U.S. Cl. ..... 415/204; 415/206; 415/208.1; 415/211.2

(58) Field of Search ..... 415/203, 204, 415/206, 208.1, 208.3, 211.1, 211.2, 212.1

(56) References Cited

U.S. PATENT DOCUMENTS 5,738,492 A * 4/1998 Stanko et al. ..... 415/211.1

FOREIGN PATENT DOCUMENTS

JP 53138507 A * 12/1978 ..... F04D/29/66

* cited by examiner

*Primary Examiner*—Edward K. Look
*Assistant Examiner*—Dwayne White
(74) *Attorney, Agent, or Firm*—Marger Johnson & McCollom, P.C.

(57) ABSTRACT

A centrifugal blower with an eddy blade is disclosed. The centrifugal blower includes a multiblade impeller with a plurality of blades, and a scroll casing surrounding the multiblade impeller, with a spiral passage defined between the scroll casing and the impeller to guide air radially accelerated in the impeller to an air outlet port of the scroll casing, thus discharging the air from the scroll casing through the air outlet port. The eddy blade is installed in the spiral passage at a position around the air outlet port to generate a uniform current velocity distribution of air, thus preventing generation of an eddy at variance with a main current in a stream of air.

5 Claims, 3 Drawing Sheets

CENTRIFUGAL BLOWER WITH EDDY BLADE

BACKGROUND OF THE INVENTION

1. Field of the Invention

The present invention relates, in general, to centrifugal blowers used for moving air by accelerating it radially outward within an impeller to a surrounding casing of scroll shape and, more particularly, to a centrifugal blower provided with an eddy blade in an air outlet port of the casing to generate a uniform current velocity distribution of air, and thereby prevent generation of an eddy at variance with a main current in a stream of air.

2. Description of the Prior Art

As well known to those skilled in the art, centrifugal blowers are machines in which air is sucked into an impeller in an axial direction, and is accelerated radially within the impeller to a surrounding casing of scroll shape to be discharged from the casing in a direction perpendicular to the air inlet direction. The centrifugal blowers are preferably used as machines for feeding air under constant pressure.

A conventional centrifugal blower is shown in FIG. 1. As shown in the drawing, the centrifugal blower comprises a multiblade impeller 4 with a plurality of blades arranged around a rotor, and a scroll casing 6 surrounding the multiblade impeller 4, with a spiral passage defined between the scroll casing 6 and the impeller 4 to guide air radially accelerated in the impeller 4 to an air outlet port of the scroll casing, thus discharging the air from the scroll casing 6 through the air outlet port.

An air inlet port (not shown) is formed at the scroll casing 6 in an axial direction of the impeller 4, and the air outlet port 8 is formed at the casing 6 such that the outlet port 8 is perpendicular to the air inlet port.

In the operation of the centrifugal blower, air is sucked into the impeller 4 through the air inlet port due to a suction force generated by a rotation of the impeller 4, and is accelerated radially in the impeller 4 to the scroll casing 6. In such a case, due to the scroll shape of the casing 6, air under constant pressure is discharged from the casing 6 through the air outlet port 8.

However, when the flow rate of outlet air from the centrifugal blower exceeds a predetermined reference level, a velocity gradient of air flowing in the outlet port 8 is generated, so that an eddy at variance with a main current in a stream of air is generated. The eddy substantially reduces blower efficiency, and produces operating noise of the blower.

That is, air flowing in the outlet port 8 has a nonuniform current velocity distribution V such that the air current velocity is gradually increased in proportion to the distance from the center of the impeller 4, as shown by the arrows of FIG. 2. Therefore, a clockwise eddy E at variance with the main current in the stream of air is generated in the outlet port 8. The nonuniform current velocity distribution V of air and the clockwise eddy reduce the flow rate of air, thus reducing the blower efficiency and generating operating noise of the blower.

SUMMARY OF THE INVENTION

Accordingly, the present invention has been made keeping in mind the above problems occurring in the prior art, and an object of the present invention is to provide a centrifugal blower with an eddy blade, in which the eddy blade prevents generation of an eddy in the air outlet port of a scroll casing, thus enhancing blower efficiency and reducing operating noise of the blower.

In order to accomplish the above objects, the present invention provides a centrifugal blower, comprising a multiblade impeller with a plurality of blades arranged around a rotor, and a scroll casing surrounding the multiblade impeller, with a spiral passage defined between the scroll casing and the impeller to guide air radially accelerated in the impeller to an air outlet port of the scroll casing, thus discharging the air from the scroll casing through the air outlet port, further comprising an eddy blade installed in the spiral passage at a position around the air outlet port to generate a uniform current velocity distribution of air, thus preventing generation of an eddy at variance with a main current in a stream of air, wherein the eddy blade is placed in the spiral passage such that leading and trailing edges thereof are directed toward an interior and the air outlet port of the scroll casing, respectively, and the eddy blade is inclined downward from the leading edge to the trailing edge at a predetermined angle of inclination β relative to a horizontal axis.

In the centrifugal blower, the angle of inclination β of the eddy blade is preferably set to 13°~25°.

The leading and trailing edges of the eddy blade are preferably rounded forward and rearward in vertical directions at predetermined radiuses of curvature (R1, R2).

The radius of curvature (R1) of the leading edge, the radius of curvature (R2) of the trailing edge, and a distance (C) between centers of curvature of the leading and trailing edges are preferably expressed as follows:

$$R1=(0.08\sim0.1)\times(D2-D1)/4$$

$$R2=(0.03\sim0.05)\times(D2-D1)/4$$

$$C=(0.95\sim1.01)\times(D2-D1)/2$$

where D1 is an inner diameter of the impeller equal to a diameter of the rotor, and D2 is an outer diameter of the impeller including the blades.

The eddy blade, placed in the spiral passage of the scroll casing, is preferably rounded upward in a latitudinal direction at a lower surface thereof at a predetermined radius of curvature (R3), and is preferably rounded upward in the latitudinal direction at an upper surface thereof at another predetermined radius of curvature (R4).

The radiuses of curvature (R3, R4) of the lower and upper surfaces are preferably expressed as follows:

$$R3=1.2D1$$

$$R4=(0.7\sim0.9)D1$$

where D1 is the inner diameter of the impeller equal to the diameter of the rotor.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
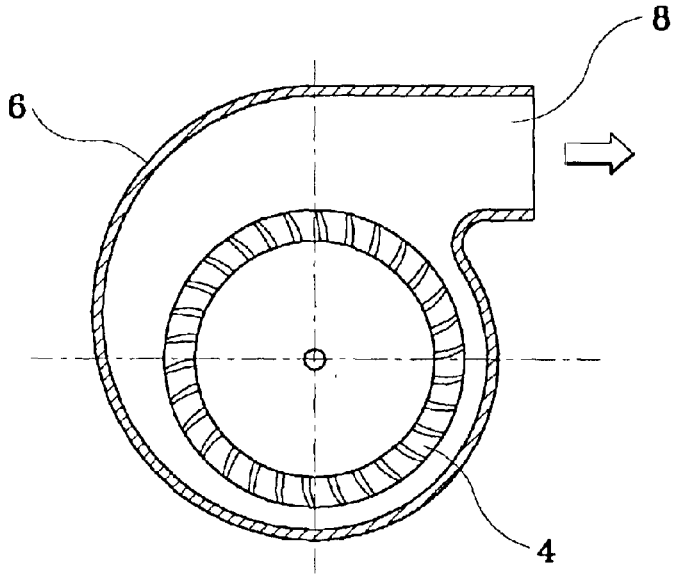
FIG.1 (Prior art)
FIG. 1 is a sectional view of a conventional centrifugal blower.
Figure 2:
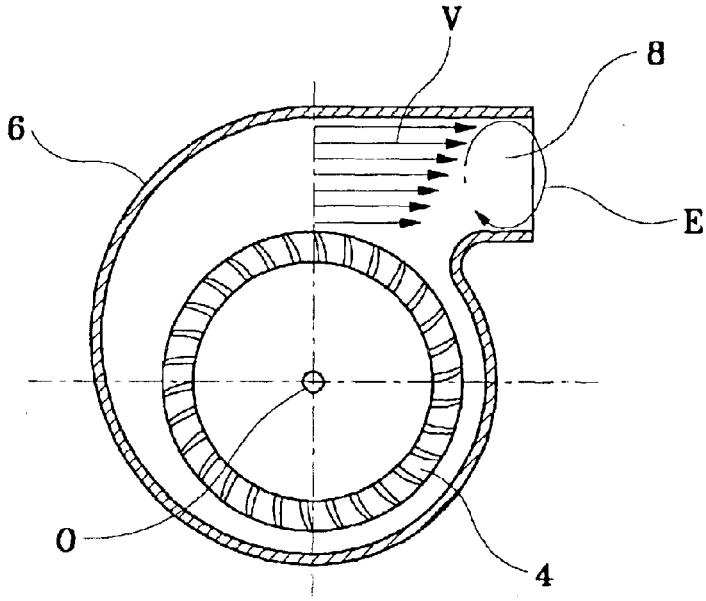
FIG.2 (Prior art)
FIG. 2 is a view corresponding to FIG. 1, showing a nonuniform current velocity distribution of air in an air outlet port of the conventional centrifugal blower.

Reference should now be made to the drawings, in which the same reference numerals are used throughout the different drawings to designate the same or similar components.

Figure 3:
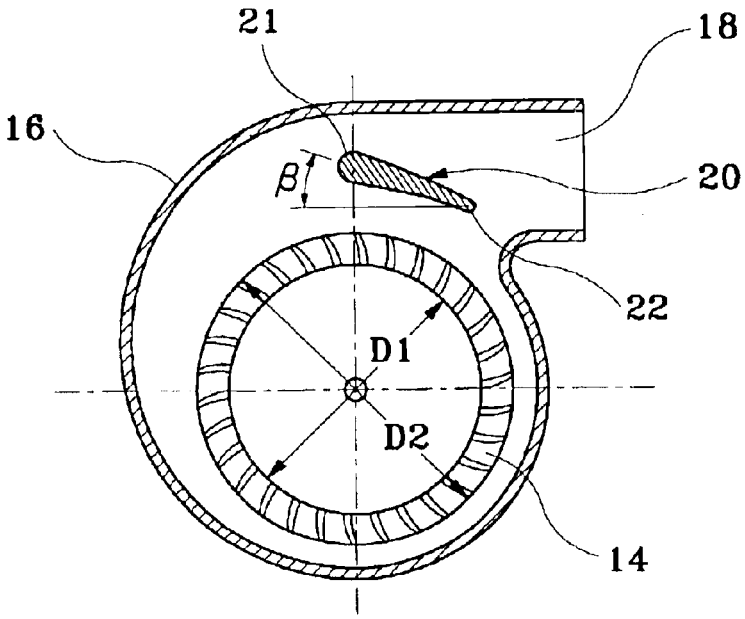
FIG. 3 is a sectional view of a centrifugal blower with an eddy blade in accordance with a preferred embodiment of the present invention.

FIG. 3 is a sectional view of a centrifugal blower with an eddy blade in accordance with a preferred embodiment of the present invention. As shown in the drawing, the centrifugal blower of the present invention comprises a multiblade impeller 14 with a plurality of blades arranged around a rotor, and a scroll casing 16 surrounding the multiblade impeller 14, with a spiral passage defined between the scroll casing 16 and the impeller 14 to guide air radially accelerated in the impeller 14 to an air outlet port 18 of the scroll casing 16, thus discharging the air from the scroll casing 16 through the air outlet port 18. An air inlet port (not shown) is formed at the scroll casing 16 in an axial direction of the impeller 14 to suck air into the impeller 14, and the air outlet port 18 is formed at the casing 16 such that the outlet port 18 is perpendicular to the air inlet port. An eddy blade 20 is installed in the spiral passage at a position around the air outlet port 18 to generate a uniform current velocity distribution of air in the outlet port 18, thus preventing generation of an eddy at variance with a main current in a stream of air.

The eddy blade 20 is placed in the spiral passage around the air outlet port 18 such that the leading and trailing edges 21 and 22 thereof are directed toward the interior and the air outlet port 18 of the scroll casing 16, respectively. In addition, the eddy blade 20 is inclined downward from the leading edge 21 to the trailing edge 22 at a predetermined angle of inclination β relative to a horizontal axis. The angle of inclination β of the eddy blade is set to 13°~25°.

Figure 4:
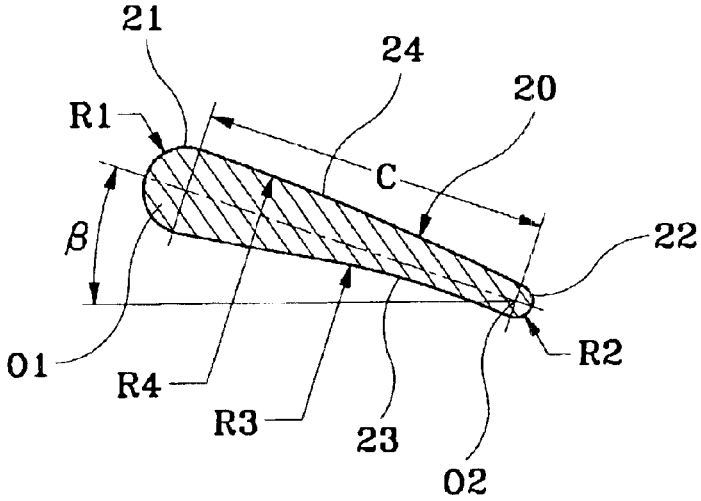
FIG. 4 is a sectional view of the eddy blade included in the centrifugal blower according to the present invention.

The eddy blade 20 has a cross-section similar to that of a conventional wing of an airplane, and the leading and trailing edges 21 and 22 of the eddy blade 20 are rounded forward and rearward in vertical directions at predetermined radiuses of curvature R1 and R2, as shown in FIG. 4. The eddy blade 20 is also rounded upward in a latitudinal direction at a lower surface 23 thereof at a predetermined radius of curvature R3, and is rounded upward in the latitudinal direction at an upper surface 24 thereof at another predetermined radius of curvature R4.

The radius of curvature R1 of the leading edge 21, the radius of curvature R2 of the trailing edge 22, and a distance C between the centers of curvature O1 and O2 of the leading and trailing edges 21 and 22 are expressed as follows:

$$R1=(0.08\sim0.1)\times(D2-D1)/4$$

$$R2=(0.03\sim0.05)\times(D2-D1)/4$$

$$C=(0.95\sim1.01)\times(D2-D1)/2$$

where D1 is the inner diameter of the impeller 14 equal to the diameter of the rotor, and D2 is the outer diameter of the impeller 14 including the blades.

In addition, the radiuses of curvature R3 and R4 of the lower and upper surfaces 23 and 24 of the eddy blade 20 are expressed as follows:

$$R3=1.2D1$$

$$R4=(0.7\sim0.9)D1$$

where D1 is the inner diameter of the impeller 14 equal to the diameter of the rotor.

Figure 5:
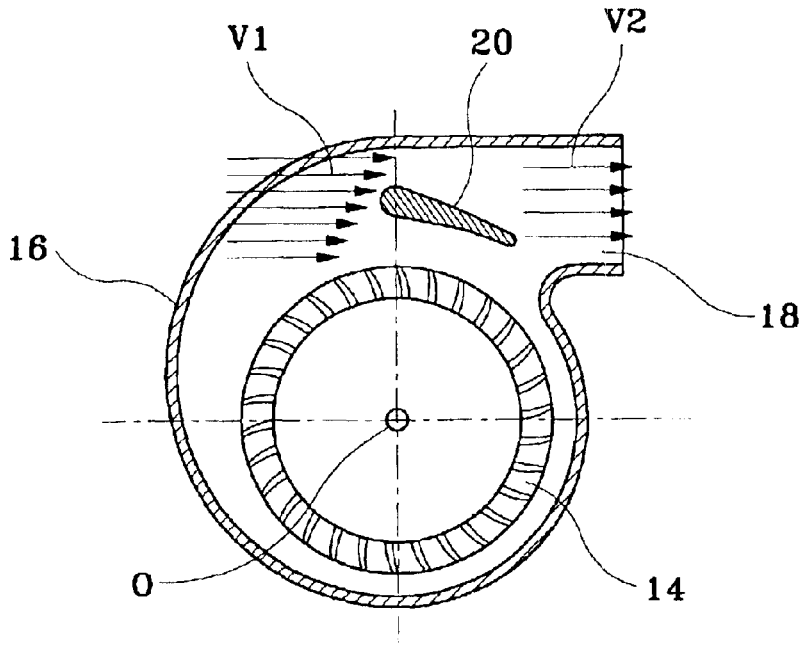
FIG. 5 is a view corresponding to FIG. 3, showing a uniform current velocity distribution of air in an air outlet port of the centrifugal blower according to the present invention.

FIG. 5 shows a current velocity distribution of air in the air outlet port 18 having the eddy blade 20. As shown in the drawing, air, flowing in the spiral passage before the leading edge of the eddy blade 20, has a nonuniform current velocity distribution V1 such that the air current velocity is gradually increased in proportion to the distance from the center O of the impeller 14. However, as the air passes by the eddy blade 20, the current velocity of air flowing under the lower surface 23 of the blade 20 is increased, and the current velocity of air flowing over the upper surface 24 of the blade 20 is reduced, so that the air, flowing in the spiral passage after the trailing edge of the eddy blade 20, has a uniform current velocity distribution V2, thus preventing generation of an eddy in the air outlet port 18.

In order to experimentally confirm the operational effect of the centrifugal blower of this invention, a centrifugal blower of FIG. 3 with an eddy blade and a conventional centrifugal blower of FIG. 1 without an eddy blade were tested under the same conditions to measure the flow rates of air and operating noises, and the test results are given in Table. In the test, the angle of inclination of the eddy blade in the spiral passage of the scroll casing was 18°. The test conditions were as follows:

Testing Machine: a wind tunnel with a flow rate of 1.5~50 $m^3$/min, designed and manufactured in accordance with the standard of American Society of Heating, Refrigerating and Air-Conditioning Engineers (ASHRAE).

Testing Process: the test was performed in accordance with KSB 6311.

TABLE

| Blowers | Flow rate ($m^3$/min) | Noise (dB) |
|---|---|---|
| This Blower | 26 | 51 |
| Conventional Blower | 23.5 | 56.8 |

As shown in the Table, in comparison with the conventional centrifugal blower without an eddy blade, the centrifugal blower with the eddy blade according to the present invention is increased in its flow rate by 2.5 $m^3$/min, thus having an enhanced blower efficiency, and reduced in its operating noise by 5.8 dB, thus accomplishing a quiet operation.

Figure 6:
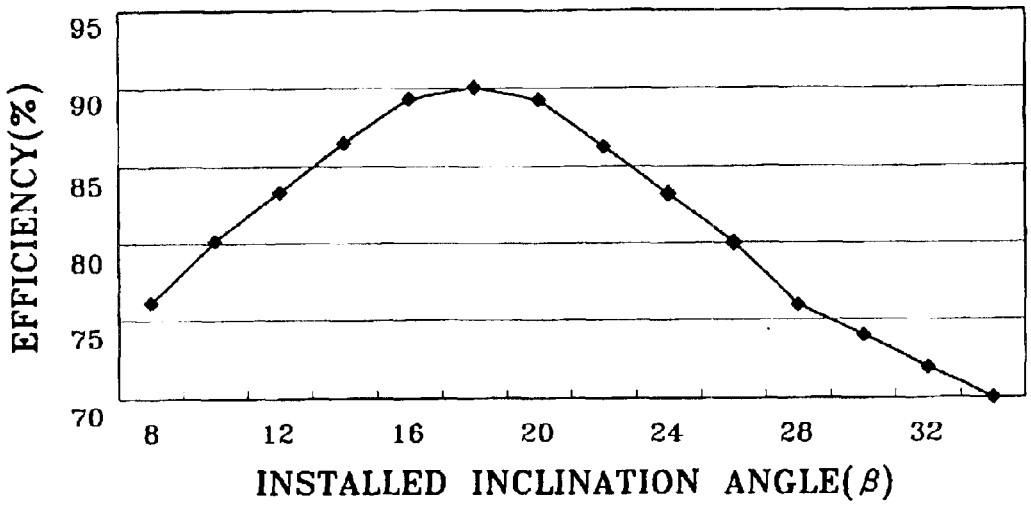
FIG. 6 is a graph showing blower efficiency as a function of an angle of inclination of the eddy blade for the centrifugal blower of FIG. 3.

FIG. 6 is a graph showing blower efficiency as a function of the angle of inclination β of the eddy blade 20 for the centrifugal blower of the present invention. As shown in the graph, the eddy blade maximizes the blower efficiency when the inclination angle β is set to about 18°, and it is noted that the preferable range of the inclination angle β of the eddy blade 20 is about 13°~25°.

As described above, the present invention provides a centrifugal blower with an eddy blade. In the centrifugal blower of this invention, the eddy blade prevents generation of an eddy in the air outlet port of the scroll casing, thus increasing the flow rate of air to enhance blower efficiency, and reducing operating noise of the blower.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A centrifugal blower, comprising a multiblade impeller with a plurality of blades arranged around a rotor, and a scroll casing surrounding said multiblade impeller, with a spiral passage defined between the scroll casing and the impeller to guide air radially accelerated in the impeller to an air outlet port of said scroll casing, thus discharging the air from the scroll casing through said air outlet port, further comprising:

an eddy blade installed in said spiral passage at a position around the air outlet port to generate a uniform current velocity distribution of air, thus preventing generation of an eddy at variance with a main current in a stream of air, wherein said eddy blade is placed in said spiral passage such that leading and trailing edges thereof are directed toward an interior and the air outlet port of the scroll casing, respectively, and the eddy blade is inclined downward from the leading edge to the trailing edge at a predetermined angle of inclination relative to a horizontal axis, wherein said leading and trailing edges of said eddy blade are rounded forward and rearward in vertical directions at predetermined radiuses of curvature (R1, R2), wherein the radius of curvature (R1) of said leading edge, the radius of curvature (R2) of said trailing edge, and a distance (C) between centers of curvature of said leading and trailing edges are expressed as follows:

$$R1=(0.08\sim0.1)\times(D2-D1)/4$$

$$R2=(0.03\sim0.05)\times(D2-D1)/4$$

$$C=(0.95\sim1.01)\times(D2-D1)/2$$

where D1 is an inner diameter of said impeller equal to a diameter of said rotor, and D2 is an outer diameter of said impeller including the blades.

2. The centrifugal blower according to claim 1, wherein said angle of inclination of the eddy blade is set to 130°~25°.

3. The centrifugal blower according to claim 1, wherein said eddy blade placed in the spiral passage of the scroll casing is rounded upward in a latitudinal direction at a lower surface thereof at a predetermined radius of curvature (R3), and is rounded upward in the latitudinal direction at an upper surface thereof at another predetermined radius of curvature (R4).

4. The centrifugal blower according to claim 3, wherein the radiuses of curvature (R3, R4) of said lower and upper surfaces are expressed as follows:

$$R3=1.2D1$$

$$R4=(0.7\sim0.9)D1$$

where D1 is the inner diameter of said impeller equal to the diameter of the rotor.

5. A centrifugal blower, comprising a multiblade impeller with a plurality of blades arranged around a rotor, and a scroll casing surrounding said multiblade impeller, with a spiral passage defined between the scroll casing and the impeller to guide air radially accelerated in the impeller to an air outlet port of said scroll casing, thus discharging the air from the scroll casing through said air outlet port, further comprising:

an eddy blade installed in said spiral passage at a position around the air outlet port to generate a uniform current velocity distribution of air, thus preventing generation of an eddy at variance with a main current in a stream of air, wherein said eddy blade is placed in said spiral passage such that leading and trailing edges thereof are directed toward an interior and the air outlet port of the scroll casing, respectively, and the eddy blade is inclined downward from the leading edge to the trailing edge at a predetermined angle of inclination relative to a horizontal axis, wherein said eddy blade placed in the spiral passage of the scroll casing is rounded upward in a latitudinal direction at a lower surface thereof at a predetermined radius of curvature (R3), and is rounded upward in the latitudinal direction at an upper surface thereof at another predetermined radius of curvature (R4), wherein the radiuses of curvature (R3, R4) of said lower and upper surfaces are expressed as follows:

$$R3=1.2D1$$

$$R4=(0.7\sim0.9)D1$$

where D1 is the inner diameter of said impeller equal to the diameter of the rotor.

* * * * *

UNITED STATES PATENT AND TRADEMARK OFFICE

CERTIFICATE OF CORRECTION

PATENT NO. : 6,817,832 B2
DATED : November 16, 2004
INVENTOR(S) : Kim et al.

It is certified that error appears in the above-identified patent and that said Letters Patent is hereby corrected as shown below:

Column 5,
Line 47, replace "set to 130°~25°" to -- set to 13°~25° --.

Signed and Sealed this

Twenty-seventh Day of December, 2005

JON W. DUDAS
*Director of the United States Patent and Trademark Office*